US010344394B1

(12) United States Patent
Olson

(10) Patent No.: US 10,344,394 B1
(45) Date of Patent: Jul. 9, 2019

(54) SYSTEM AND METHOD OF ELECTROCHEMICAL CLEANING OF METAL DISCOLORATION

(71) Applicant: Jay Olson, Gilbert, AZ (US)

(72) Inventor: Jay Olson, Gilbert, AZ (US)

( * ) Notice: Subject to any disclaimer, the term of this patent is extended or adjusted under 35 U.S.C. 154(b) by 640 days.

(21) Appl. No.: 14/562,520

(22) Filed: Dec. 5, 2014

(51) Int. Cl.

| | |
|---|---|
| ***C25F 1/00*** | (2006.01) |
| ***C25F 7/00*** | (2006.01) |
| ***H01F 27/28*** | (2006.01) |
| ***H01F 27/40*** | (2006.01) |

(52) U.S. Cl.
CPC ..... *C25F 7/00* (2013.01); *C25F 1/00* (2013.01); *H01F 27/2823* (2013.01); *H01F 27/40* (2013.01)

(58) Field of Classification Search
None
See application file for complete search history.

(56) References Cited

U.S. PATENT DOCUMENTS 3,196,094 A * 7/1965 Davis, Jr. ..... C25F 3/12 204/224 R
3,207,685 A * 9/1965 Pavlic ..... C25F 7/00 204/224 R
4,206,028 A * 6/1980 Inoue ..... B23H 3/02 204/224 M
5,964,990 A * 10/1999 Muratori ..... C25F 7/00 204/224 M

FOREIGN PATENT DOCUMENTS

JP 2012241227 A * 12/2012 ..... C25F 1/06

OTHER PUBLICATIONS

Transformer, http://web.archive.org/web/20130308024249/https://en.wikipedia.org/wiki/Transformer, Mar. 8, 2013.*

* cited by examiner

*Primary Examiner* — Nicholas A Smith
(74) *Attorney, Agent, or Firm* — Spencer Fane LLP; Steven J. Laureanti

(57) ABSTRACT

An electrochemical cleaner is disclosed including a power supply coupled to a transformer and an electronics housing including one or more wand assembly ports and one or more ground ports. A first wand assembly port of the one or more wand assembly ports is electronically coupled to a first wire coupled to a magnet wire of the transformer and a ground connector is electronically coupled to approximately the first end of the magnet wire. The electrochemical cleaner also includes a voltage selector configured to select between a plurality of voltage potentials between a wand assembly connector and the ground connector and a wand assembly comprising a handle coupled to a length of wire and an electrode port, the electrode port configured to couple to an electrode shaft.

5 Claims, 13 Drawing Sheets

SYSTEM AND METHOD OF ELECTROCHEMICAL CLEANING OF METAL DISCOLORATION

TECHNICAL FIELD

The present disclosure relates generally to a system and method of electrochemical cleaning of metal discoloration and specifically to electrochemical cleaning of discoloration caused by stainless steel heat oxidation.

BACKGROUND

Metal component fabrication and manufacturing often leads to discoloration caused by heat-generating metal manufacturing processes such as welding, including welding of stainless steel, plasma cutting, and grinding. Traditional techniques of removing such discoloration require deburring or grinding the affected area. However, this is a difficult and time consuming technique and has proven inadequate.

SUMMARY

An electrochemical cleaner is disclosed. The electrochemical cleaner includes a power supply coupled to a transformer and an electronics housing including one or more wand assembly ports and one or more ground ports, wherein a first wand assembly port of the one or more wand assembly ports is electronically coupled to a first wire coupled to a magnet wire of the transformer, and a ground connector is electronically coupled to approximately the first end of the magnet wire. The electrochemical cleaner further includes a voltage selector configured to select between a plurality of voltage potentials between a wand assembly connector and the ground connector and a wand assembly comprising a handle coupled to a length of wire and an electrode port, the electrode port configured to couple to an electrode shaft.

A multiple output transformer is disclosed. The multiple output transformer includes a bobbin comprising a first wall, a second wall and a spindle, the first wall including a first hole, a second hole, a third hole and a fourth hole, the second wall including a fifth hole, a sixth hole, a seventh hole, and an eighth hole. The spindle includes a first wire wrapped over the spindle, the first wire includes a first end starting through the first hole and a second end extending out of the second hole, a first thermal cutoff is placed on top of the first wire and leads of the first thermal cutoff are extended out of the first hole and a second wire wrapped over the spindle, the second wire includes a first end starting through the third hole and a second end extending out of the fourth hole, a second thermal cutoff is placed on top of the second wire and leads of the second thermal cutoff are extended out of the third hole. The first end of the first wire extending through the first hole is connected with a first lead of the first thermal cutoff extending through the first hole and the second lead of the first thermal cutoff extending through the first hole is connected with a first lead and the first end of the second wire extending through the third hole is connected with a first lead of the second thermal cutoff extending through the third hole and the second lead of the second thermal cutoff extending through the third hole is connected with a second lead. The second end of the first wire extending through the second hole is connected with a third lead, the second end of the second wire extending through the fourth hole is connected with a fourth lead. The spindle still further includes two lengths of a third wire that are connected to a fourth wire, two lengths of a fifth wire that are connected to the length of the fourth wire, two lengths of a sixth wire that are connected to the length of the fourth wire and two lengths of a seventh wire that are connected to the end of the length of the fourth wire.

BRIEF DESCRIPTION OF THE DRAWINGS

A more complete understanding of the present invention may be derived by referring to the detailed description when considered in connection with the following illustrative figures. In the figures, like reference numbers refer to like elements or acts throughout the figures.

DETAILED DESCRIPTION

Figure 1A:
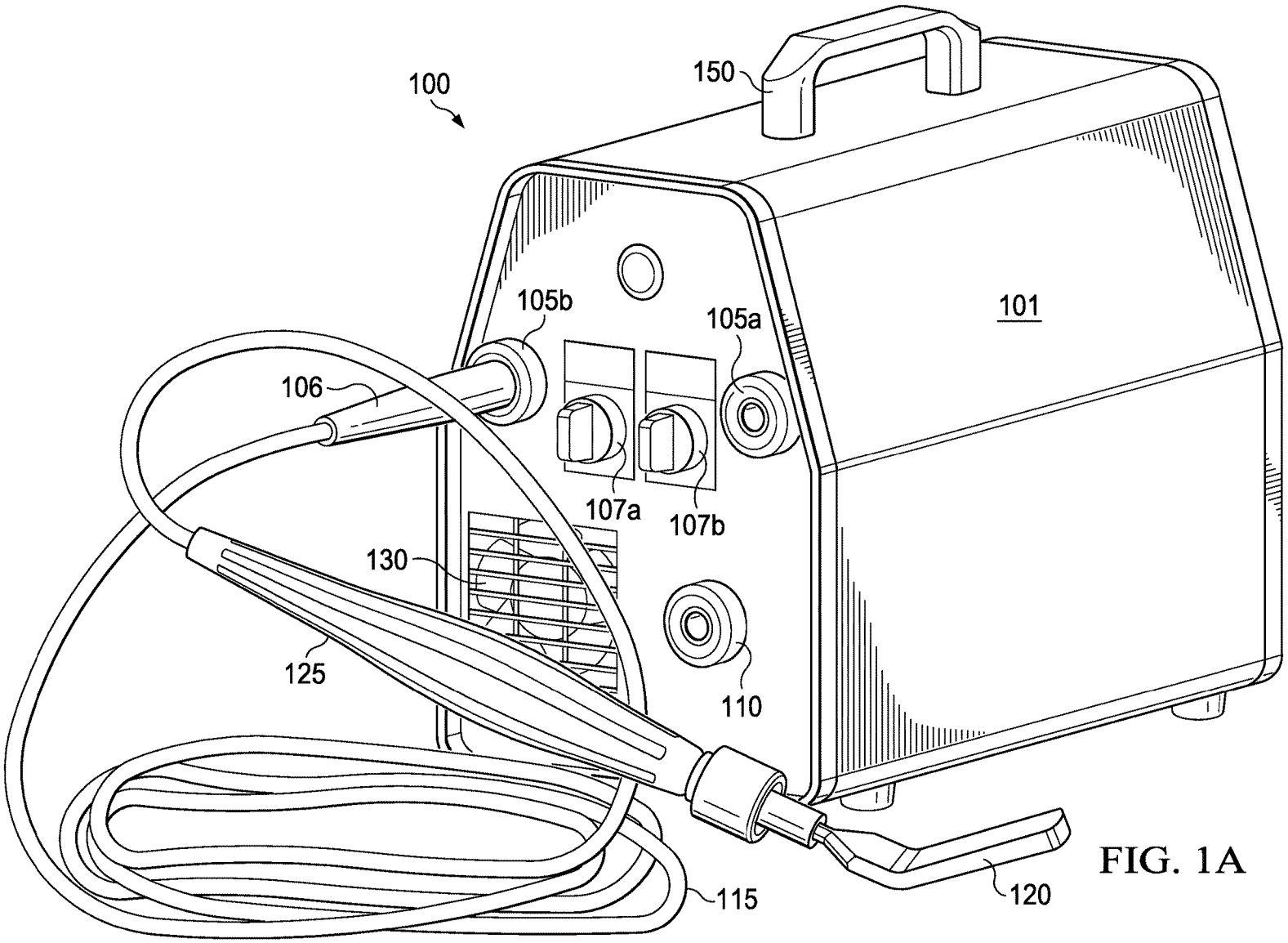
FIG. 1A illustrates an exemplary dual-output electrochemical cleaner.

Aspects and applications of the invention presented herein are described below in the drawings and detailed description of the invention. Unless specifically noted, it is intended that the words and phrases in the specification and the claims be given their plain, ordinary, and accustomed meaning to those of ordinary skill in the applicable arts.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

A system according to the preferred embodiment may include one or more of the following features. A dual-output electrochemical cleaning device having a unique functionality and composition utilizing a specially designed transformer, dual wand assemblies, independently controlled voltage selectors, control relays, chokes, and a proprietary blend of cleaning solution useful for cleaning discoloration of metals caused by, for example, welding, cutting, including plasma cutting, grinding, or certain heat-generating metal manufacturing processes.

FIG. 1 illustrates an exemplary dual-output electrochemical cleaning device 100. Dual-output electrochemical cleaning device 100 comprises body compartment 101 that encloses internal electronics 300 (see FIG. 3). In one embodiment, body compartment 101 comprises a fan 130 which moves air over the internal electronics 300 to regulate heat and prevent, for example, over-heating. Dual-output electrochemical cleaning device 100 is preferably constructed robustly to withstand considerable wear and tear from a shop environment or other working environment. For example, in some embodiments, body compartment 101 comprises a metal housing formed from sheet metal, such as 16-gauge mild steel that is formed and powder-coated. In some embodiments, metal housing is coupled to a front panel and a back panel by metal clips and/or sheet metal screws. Front and back panels are formed from any durable material, such as, plastic, metal, or the like.

Body compartment 101 further comprises a handle 150 and a plurality of electrical ports 105*a*, 105*b*, and 110. Electrical ports 105*a* and 105*b* are configured to couple with wand assembly connector 106 and ground cable port 110 is configured to couple with the ground cable connector of a ground cable. In some embodiments, the ground cable comprises a ground cable clamp at a first end and a ground cable connector at a second end. The ground cable clamp is configured to clamp either directly to one or more pieces being cleaned by cleaning device 100 or to a metal bench where one or more pieces being cleaned are electrically coupled to the metal bench.

A voltage potential between one or more electrical ports 105*a* and 105*b* and ground port 110 is effectuated by internal electronics 300. In one embodiment, a plurality of voltage switches 107*a* and 107*b* control one or more of the output voltages. In one embodiment, voltage switch 107*a* controls the voltage potential between electrical port 105*a* and ground cable port 110. In another embodiment, voltage switch 107*b* controls the voltage potential between electrical port 105*b* and ground cable port 110. In other embodiments, each voltage switch 107*a* and 107*b* independently controls the output voltage at each electrical port 105*a* and 105*b*. In one embodiment, the voltage switch 105*a* and 105*b* cause the internal electronics 300 to generate, for example, voltages of approximately 11, 32, and 43 volts, which have been determined to maximize cleaning effectiveness, as will be discussed in more detail below.

In some embodiments, output voltage is selected based on, for example, the type of weld to be cleaned, the type of metal to be cleaned, or the type of wand assembly accessory or electrode used to clean a weld. Applicant has determined that a voltage of 43 volts alternating current (VAC) is best for cleaning MIG and or TIG welds using a stainless steel electrode. Applicant has determined that a voltage of 11 VAC is best for cleaning welds in difficult to reach areas such as corners or angled welds using a carbon fiber brush of approximately 2⅝" comprising 19.9 oz/yard of 100% carbon fiber biaxial sleeve material. Furthermore, Applicant has discovered a carbon fiber brush as described herein, can disintegrate at voltages higher than approximately 11 volts. When using a metal electrode as described, an output of approximately 32 volts offers cleaning on most common weld discoloration situations. For more pervasive discoloration caused by, for example, MIG and TIG welds, an output of approximately 43 volts has been determined to work best.

Figure 1B:
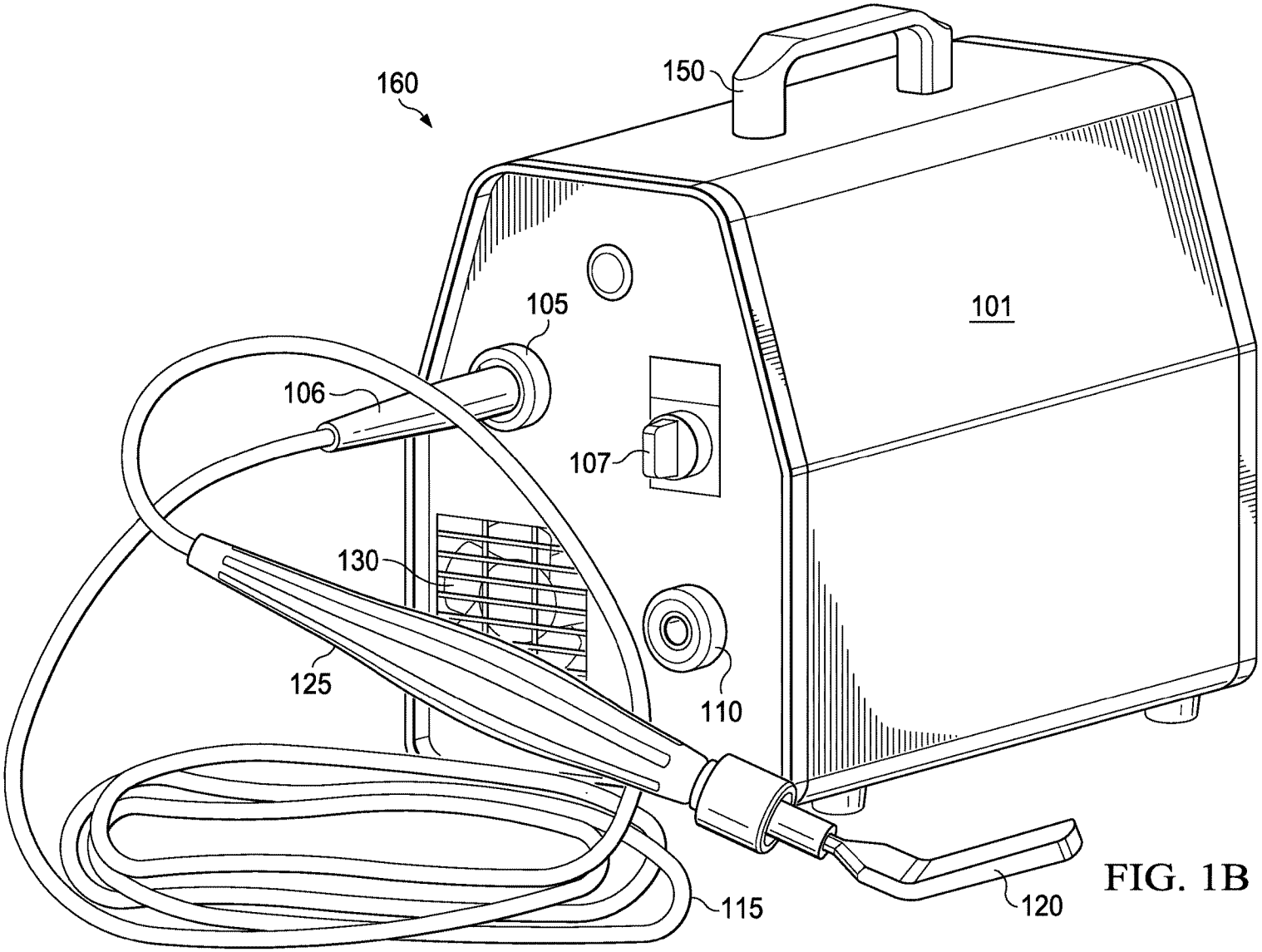
FIG. 1B illustrates an exemplary single output electrochemical cleaner.

FIG. 1B illustrates an exemplary single-output electrochemical cleaning device 160. In one embodiment, a single-output electrochemical cleaning device 160 comprises body compartment 101, handle 150, fan 130, voltage selector switch 107, electrical port 105, ground port 110, input selector switch 111, and transformer 112. In one embodiment, single-output electrochemical cleaning device 160 provides for a single wand assembly 200 to be connected to the device and provides a single voltage selector switch to control the voltage potential between electrical port 105 and ground port 110.

Figure 2:
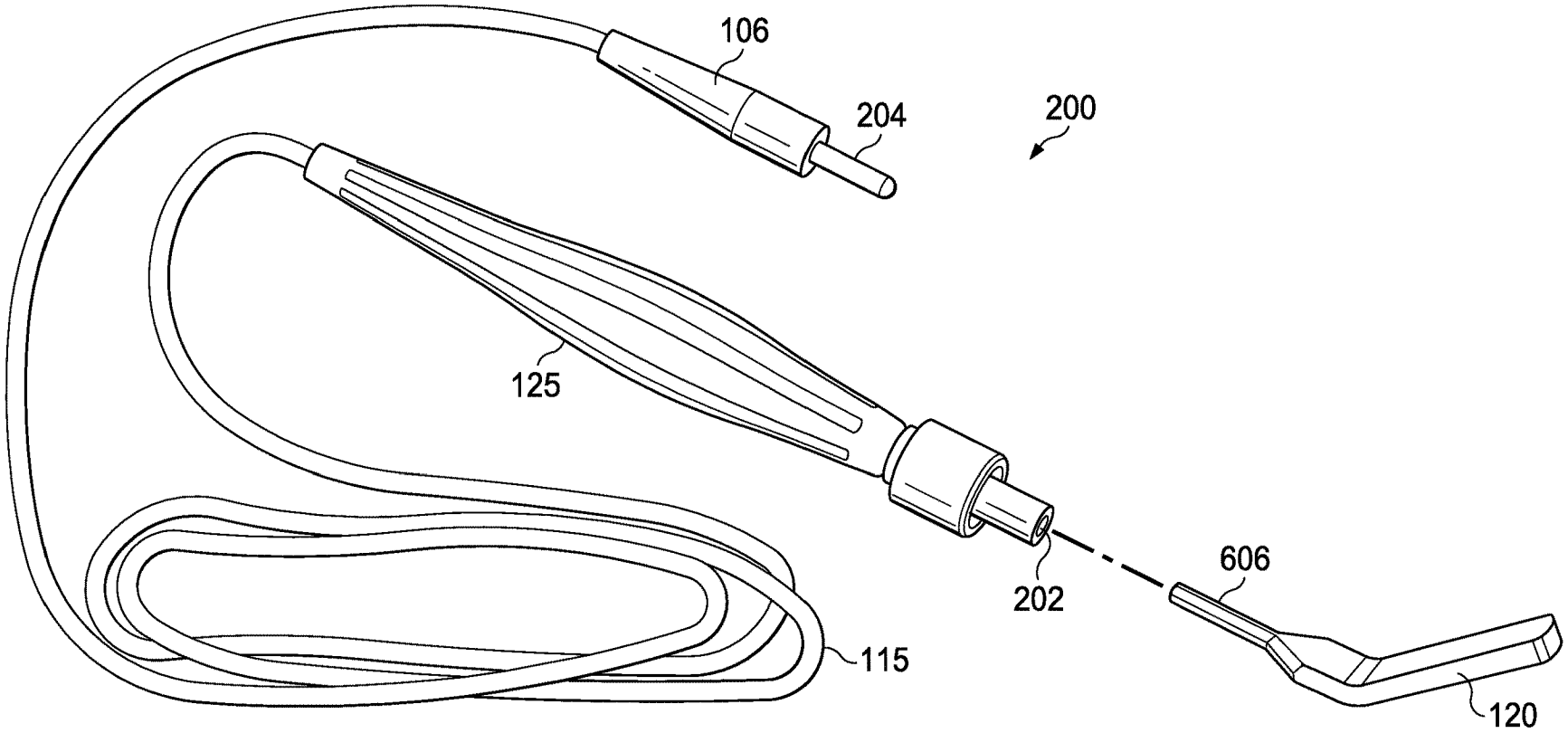
FIG. 2 illustrates an exemplary electrochemical cleaner wand.

FIG. 2 illustrates a wand assembly 200 according to an embodiment. In some embodiments, wand assembly 200 comprises wand assembly connector 106 with plug 204, wand power cable 115, wand 125, wand receptor socket 202, and/or one or more user-replaceable electrodes 120 with shaft 606. In one embodiment, the plug 204 of wand assembly connector 106 is inserted into wand assembly ports 105*a* and 105*b*. In one embodiment, wand 125 is constructed from a chemical resistant rubber with an ergonomic gripping surface. In other embodiments, user-replaceable electrode 120 is coupled with one end of wand 125 and wand power cable 115 is coupled with a second end of wand 125.

In one embodiment, a user-replaceable electrode 120 comprises one or more various shapes. As discussed in further detail below in FIGS. 6 and 7, a user-replaceable electrode 120 in one embodiment comprises a radius electrode 601, a flat electrode 602, a short brush 701, and a long brush 702. In one embodiment, different electrodes 120 are used based on the type of discoloration to be removed, the type of metal that is discolored, or other factors as discussed below.

In one embodiment, each electrode comprises a shaft 606 that is coupled to wand 125 by a receptor socket 202. In some embodiments, shaft 606 comprises a ¼" shaft, however embodiments contemplate shafts with diameters of various diameters. In some embodiments, receptor socket 202 of wand 125 comprises a ¼" receptor socket with a ¼-20×3/16" socket head set screw to secure the electrode; however, embodiments contemplate various socket sizes and configurations. In one embodiment, the electrodes 120 comprise stainless steel. Because of the heating process, an electrode 120 comprising stainless steel will erode over time. This provides the ability to replace only the electrode 120 instead of an entire wand assembly.

Figure 3:
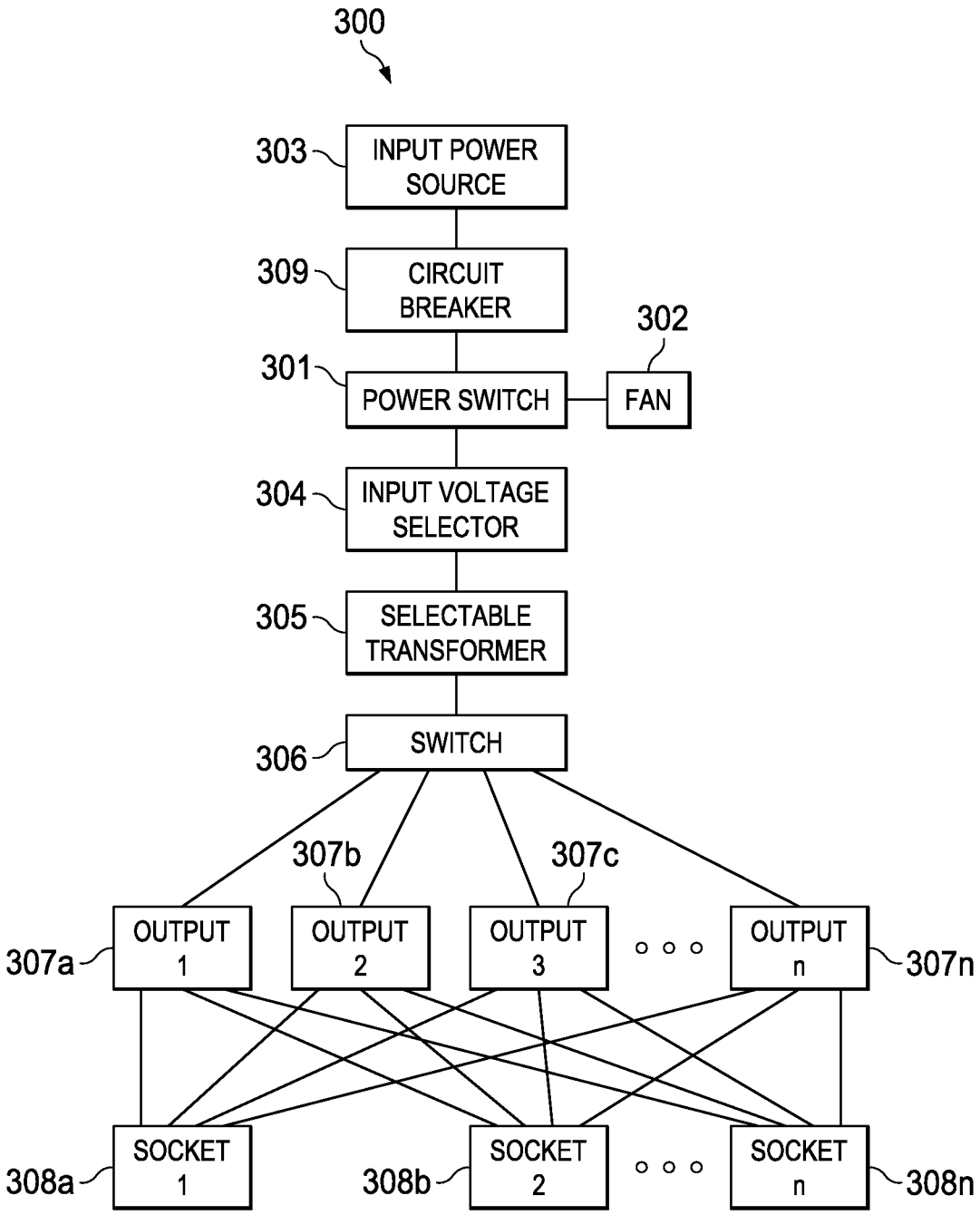
FIG. 3 illustrates an exemplary component diagram of an electrochemical cleaner.

FIG. 3 illustrates an exemplary block diagram of internal electronics 300 of dual-output electrochemical cleaning device 100 or single-output electrochemical cleaning device 160. Internal electronics 300 is coupled by wire, integrated circuit, or other conductive electrical connectors. Internal electronics 300 comprises a power supply 303. Power supply 303 provides an alternating electrical current to other components of the internal electronics 300. Power source 303 is coupled to circuit breaker 309 which protects internal electronics 300 from excessive current from short circuit conditions. Circuit breaker 309 is coupled to power switch 301 which allows the current from power source 303 to be controlled between an on and off state. In some embodiments, power switch 301 comprises a switch which stops the flow of current from the power source 303 to other internal electronics 300. In other embodiments, power switch 301 is coupled between input power source 303 and the input voltage selector 304. Input voltage selector 304 comprises one or more switches that selects between one or more circuit that allows for various power sources to be used. Input voltage selector 304 selects between a circuit responsive to approximately 110-120V AC power and a circuit responsive to approximately 220-240V AC power.

Fan 302 is coupled with power switch 301. In some embodiments, fan 302 is coupled with one or both of input voltage selector 304 and selectable transformer 305. In one embodiment, selectable transformer 305 couples with switch 306 that selects between one or more circuits that direct a different voltage to one or more outputs 307*a*, 307*b* through

307*n*. In one embodiment, each output is coupled to one or more sockets 308*a*, 308*b* though 308*n*. In some embodiments, selectable transformer 305 is selected with switch 306 to provide 11, 32, and 43 volts to a first socket 308*a* and a second socket 308*b*. In addition, or as an alternative, selectable transformer 305 couples to socket 308 comprising a ground. In one embodiment, selectable transformer 305 comprises one or more components. In embodiments with a single output, a single socket may be used.

Figure 4:
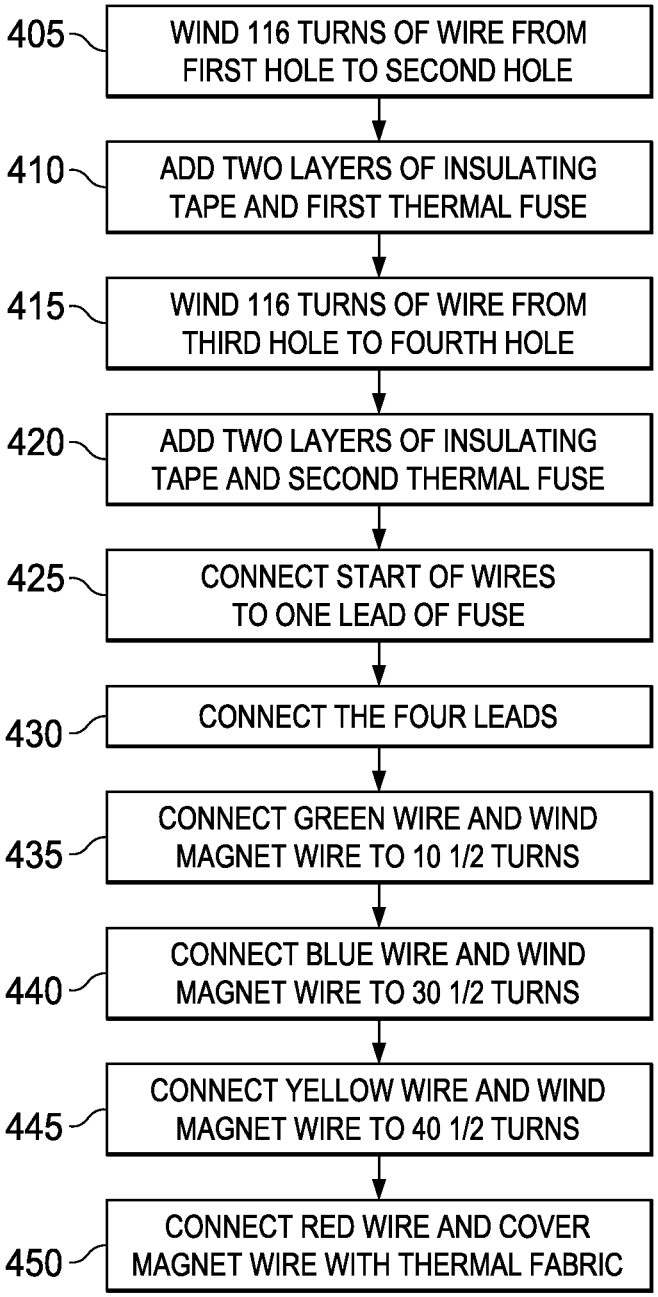
FIG. 4 illustrates an exemplary method of constructing a multiple output transformer.
Figure 5A:
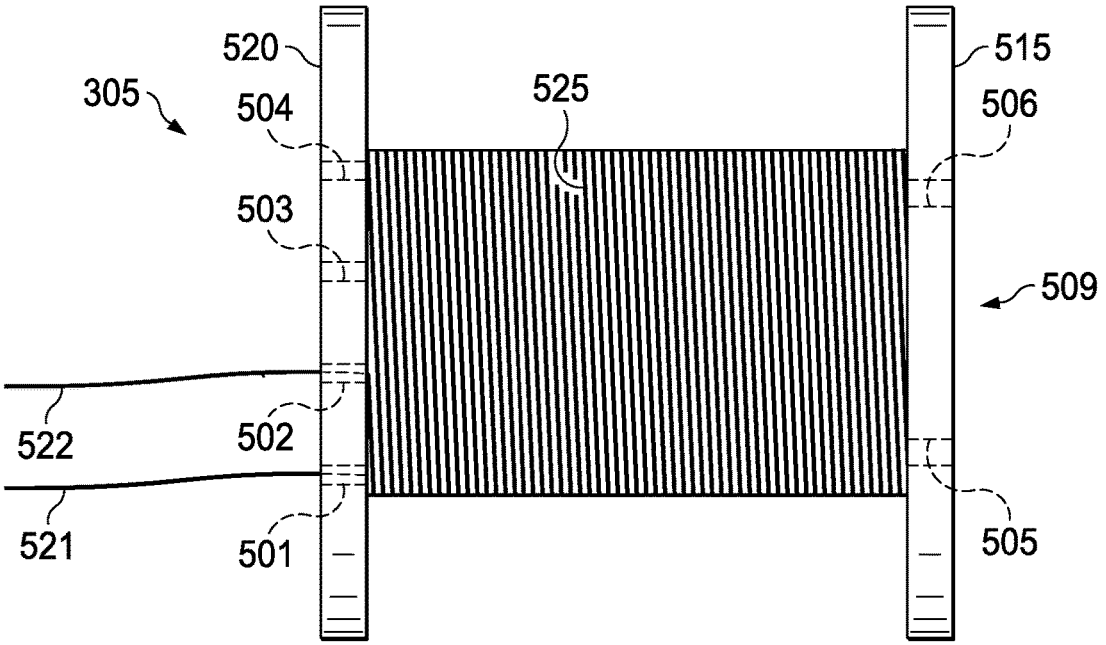
FIGS. 5A-5K illustrate a diagram of a multiple output transformer.
Figure 5B:
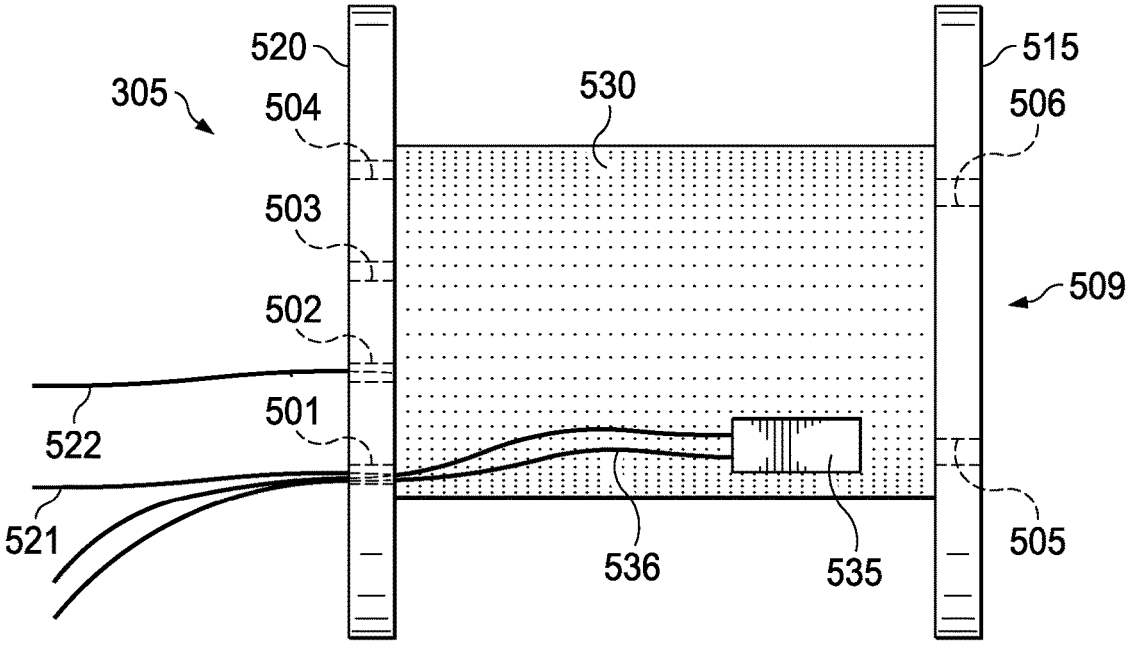
Figure 5C:
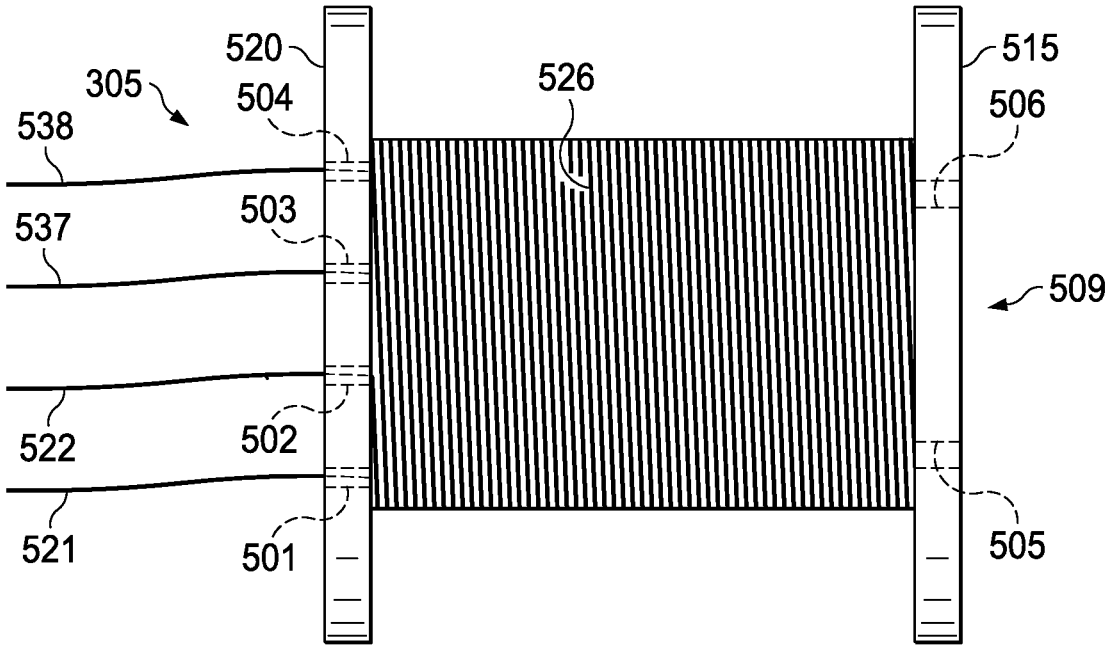
Figure 5D:
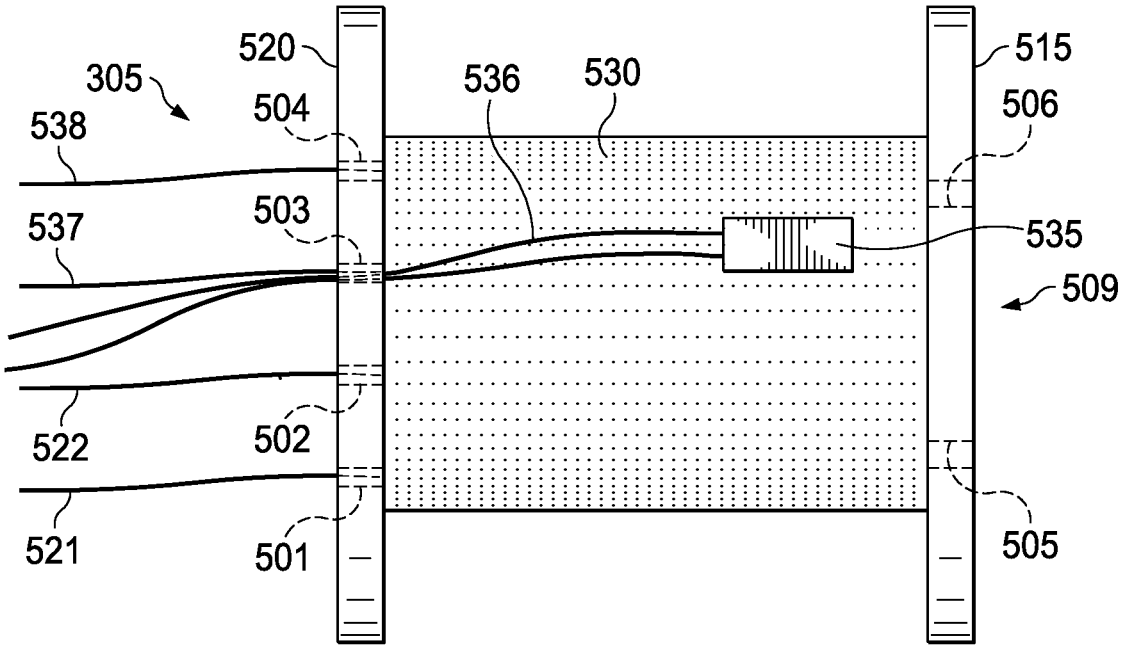

FIG. 4 illustrates an exemplary method 400 of constructing transformer 305. FIGS. 5A-5K illustrate a diagram of a multiple output transformer constructed using method 400. FIG. 5A illustrates a transformer 305. In one embodiment, transformer 305 comprises bobbin 509 with first wall 520, second wall 515, and spindle 510. In one embodiment, bobbin 509 comprises one or more openings for wire 525 to pass through first wall 520 or second wall 515 of bobbin 509 to couple with spindle 510. In some embodiments, first wall 520 of bobbin 509 comprises first hole 501, second hole 502, third hole 503, and fourth hole 504. In one embodiment, second wall 515 of bobbin 509 comprises fifth hole 505 and sixth hole 506. Although first wall 520 of bobbin 509 is illustrated as comprising four holes and the second wall 515 of bobbin 509 is illustrated as comprising two holes, embodiments contemplate a second wall 515 of bobbin 509 comprising four holes or either of the first wall 520 and second wall 515 comprising any suitable number of holes.

Referring back to FIG. 4, the method of constructing transformer 500 begins at step 405, where 116 turns of #15 AWG (American Wire Gauge) magnet wire 525 is wrapped over spindle 510 with 39 turns of wire in each layer for 3 layers. Although #15 AWG wire is shown and described, embodiments contemplate any gauge of wire according to particular needs. Wire 525 comprises first end 521 and starts from first hole 501 and finishes with wire 525 having second end 522 extending out of second hole 502. At step 410, two layers of insulating tape 530 (FIG. 5B) are wrapped over wire 525. Thermal fuse 535 is placed on top of tape 530 and leads 536 of fuse 535 are extended out of first hole 501. Two additional layers of insulating tape are laid over the thermal fuse 535. A thermal cutoff such as a thermal fuse or thermal switch is used to prevent over-heating. One-time thermal cutoffs or resettable thermal cutoffs may be used according to particular needs.

Figure 5E:
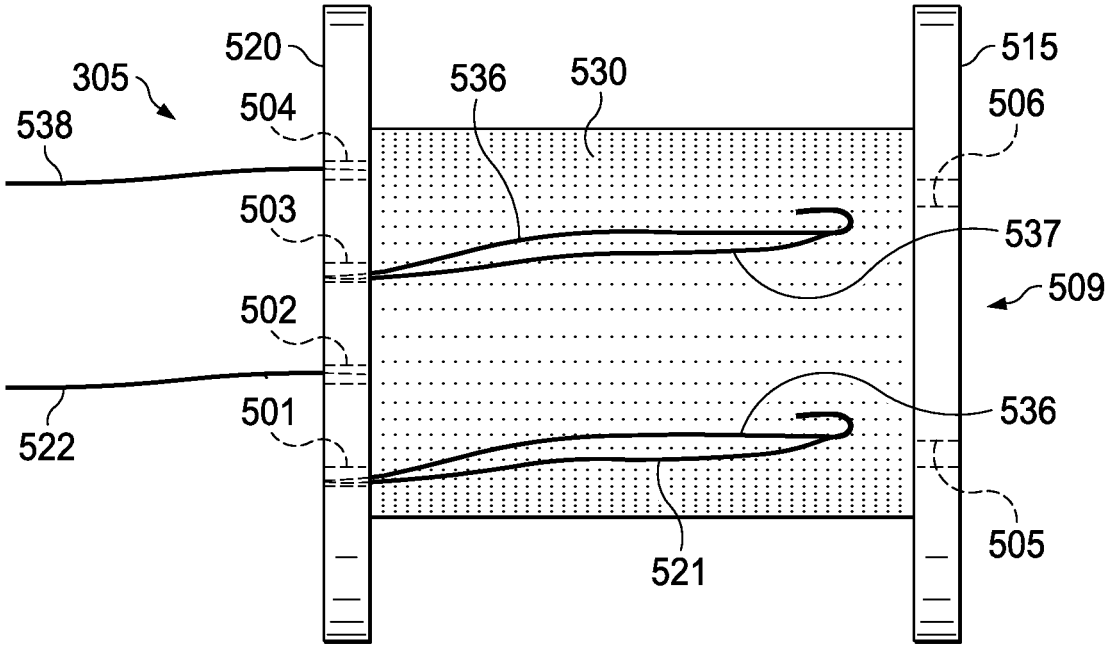

At step 415 (FIG. 5C), 116 turns of #15 AWG wire 526 are wrapped over spindle 510 with 39 turns of wire in each layer for 3 layers. Wire 526 has first end 537 and starts from the third hole 503 and finishes with wire 526 having second end 538 extending out of fourth hole 504. At step 420, two layers of insulating tape 530 (FIG. 5D) are wrapped over wire 526. Thermal fuse 535 is placed on top of tape 530 and leads 536 of fuse 535 are extended out of third hole 503. Two additional layers of insulating tape 530 are wrapped over the thermal fuse 535. At step 425 and as illustrated in FIG. 5E, the first end 521 of wire 525 extending through first hole 501 is connected to one lead 536 of thermal fuse 535 extending through first hole 501. The start of wire 537 extending through third hole 503 is connected to one lead 536 of thermal fuse 535 extending through third hole 503. Each connection is covered with Nomex paper and insulating tape.

Figure 5F:
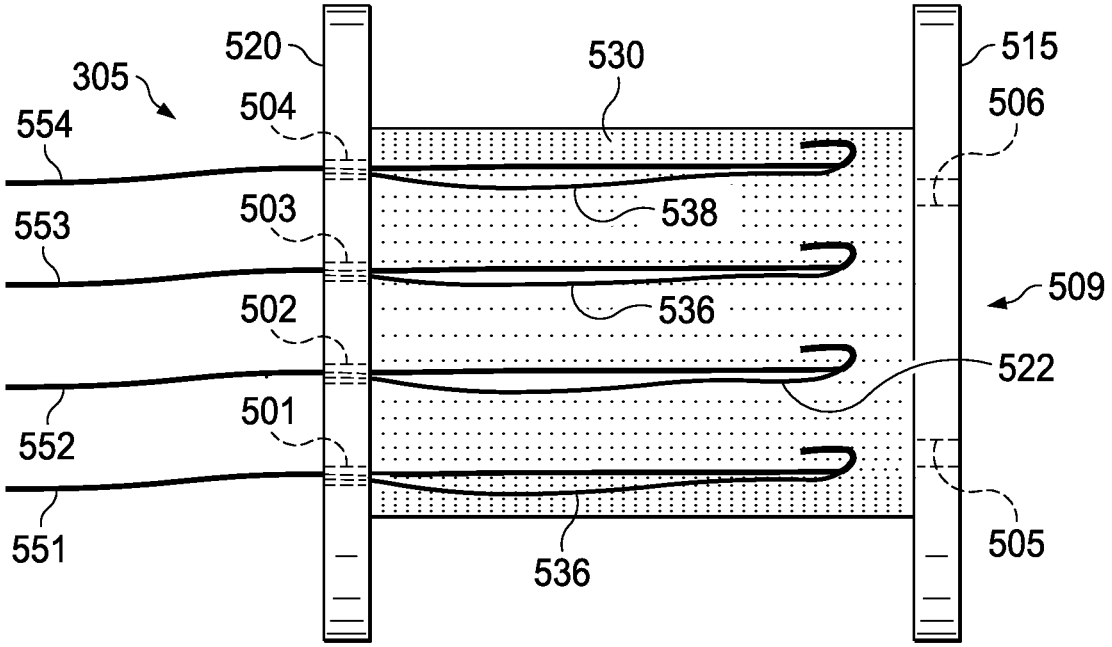

At step 430 and as illustrated in FIG. 5F, unconnected lead 536 of thermal fuse 535 extending through first hole 501 is connected to first lead 551. The unconnected lead 536 of thermal fuse 535 extending through third hole 503 is connected to second lead 553. The second end 522 of wire 525 extending through second hole 502 is connected to third lead 552. The second end 538 of wire 526 extending through fourth hole 504 is connected to fourth lead 554. Each connection is covered and the spindle 510 is covered with insulating tape 530.

Figure 5G:
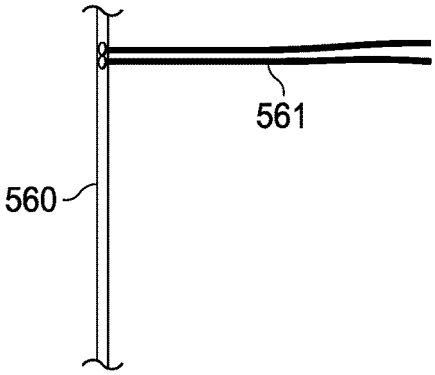
Figure 5H:
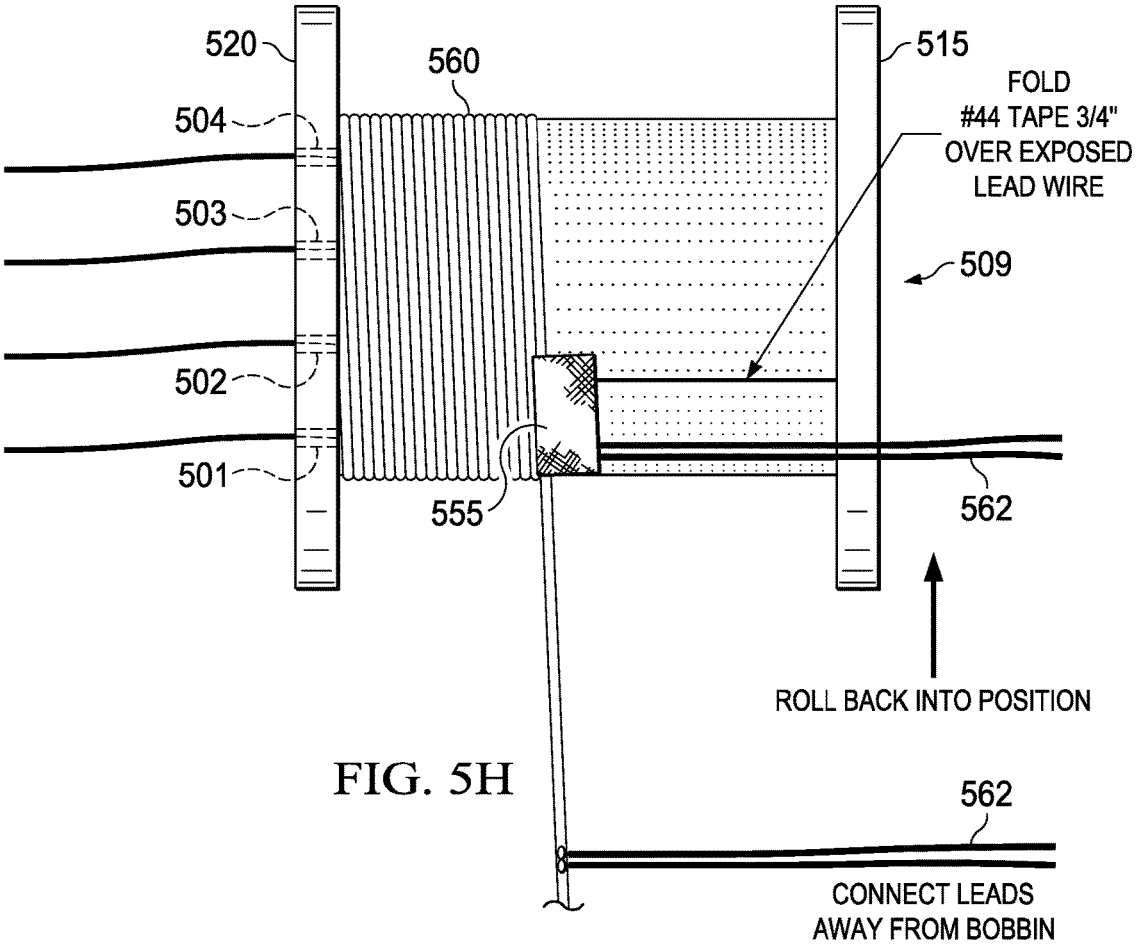

At step 435 and as illustrated in FIG. 5G, two lengths of green #12 AWG wire 561 are soldered to a length of #11 AWG magnet wire 560. Although #12 and #11 AWG wire are shown and described, embodiments contemplate any gauge wire that provides at least approximately 30 Amps. Additionally, although green wire and other color wires are herein described, the color chosen is simply for simplicity of description and any color wire may be used. A piece of thermal resistant fabric 555 is folded over the solder connection and securely attached. The solder connection is placed against the first wall 520 of bobbin 509 and the #11 AWG magnet wire 560 is wound over bobbin 509 for ten and one half turns. At step 440 and as illustrated in FIG. 5H, two lengths of blue #12 AWG wire 562 are soldered to the length of #11 AWG magnet wire 560. A piece of thermal resistant fabric 555 is folded over the solder connection and securely attached. The magnet wire 560 is wound over the bobbin 509 for thirty and one half turns.

Figure 5I:
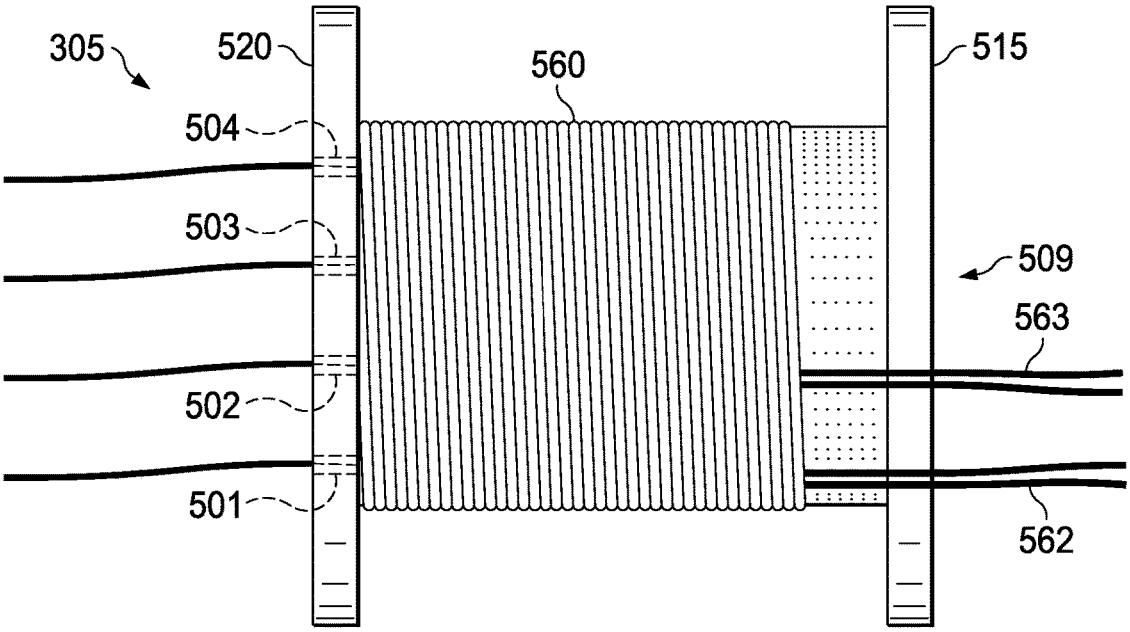
Figure 5J:
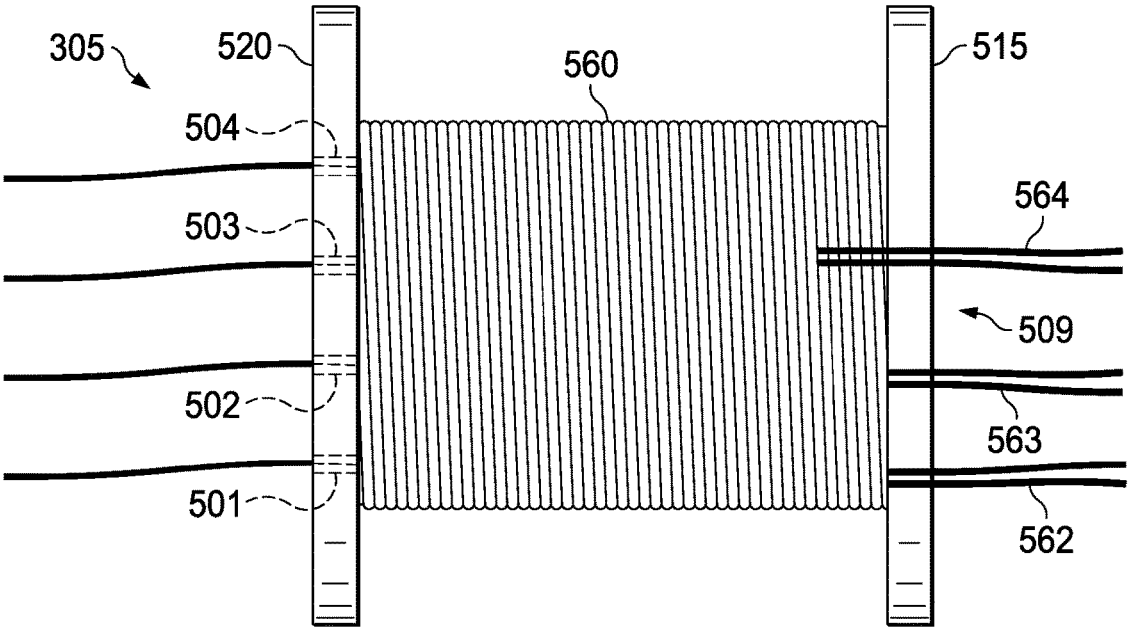
Figure 5K:
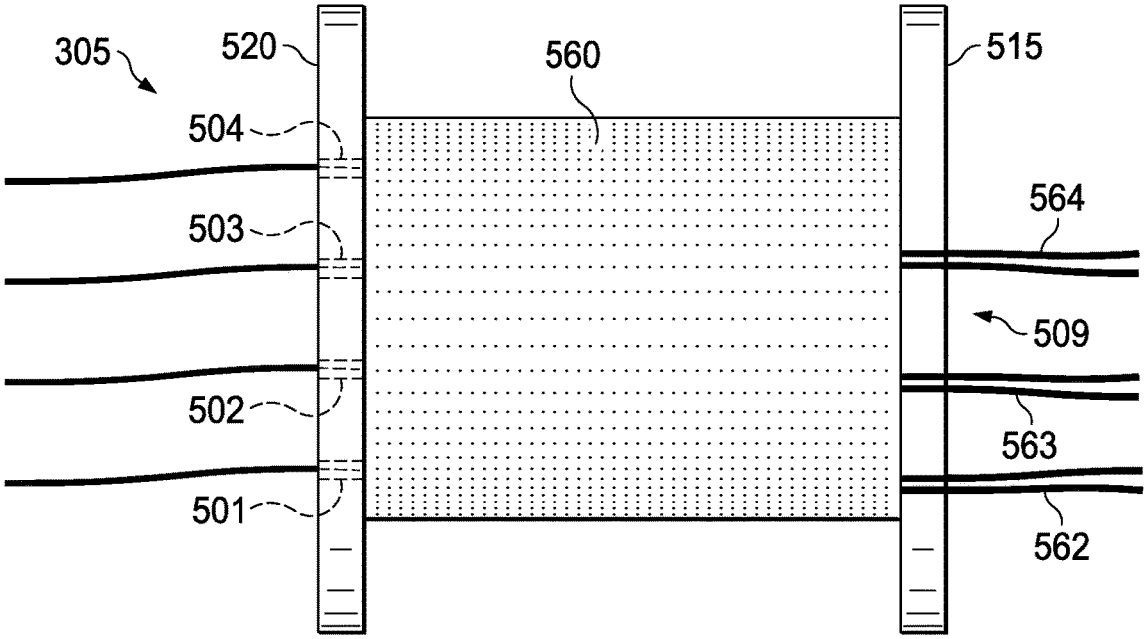

At step 445 and as illustrated in FIG. 5I, two lengths of yellow #12 AWG wire 563 are soldered to the length of #11 AWG magnet wire 560. A piece of thermal resistant fabric 555 is folded over the solder connection and securely attached. The magnet wire 560 is wound over the bobbin 509 to forty and one half turns. At step 450 and as illustrated in FIG. 5J, two lengths of red #14 AWG wire 564 are soldered to the end of the length of #11 AWG magnet wire 560. A piece of thermal resistant fabric 555 is folded over the solder connection and securely attached. All magnet wire and connections are securely covered with thermal resistant fabric 570 (FIG. 5K).

In addition, although, FIG. 4 illustrates one embodiment of a method of constructing a transformer 305, various changes may be made to method 400 without departing from the scope of embodiments of the present invention.

Figure 6A:
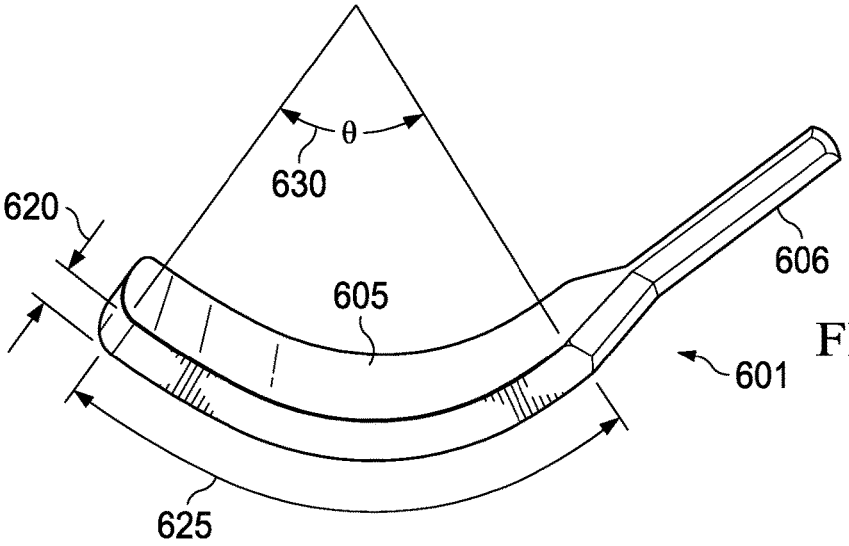
FIGS. 6A-C illustrate exemplary electrodes.
Figure 6B:
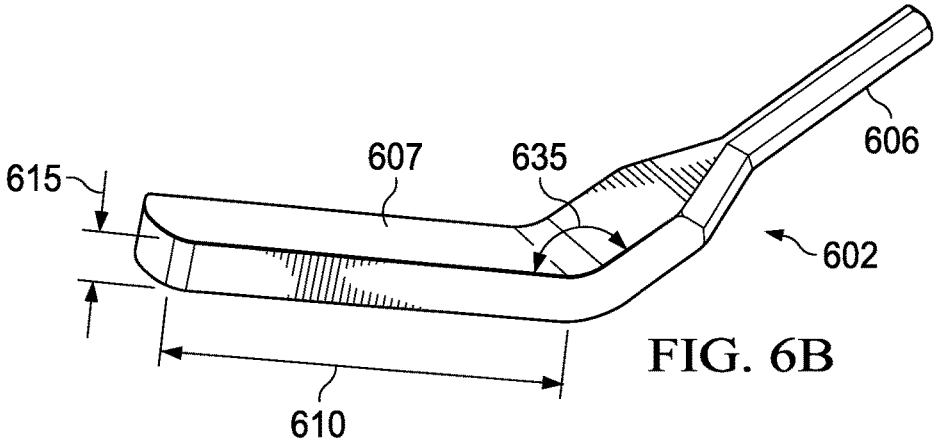
Figure 6C:
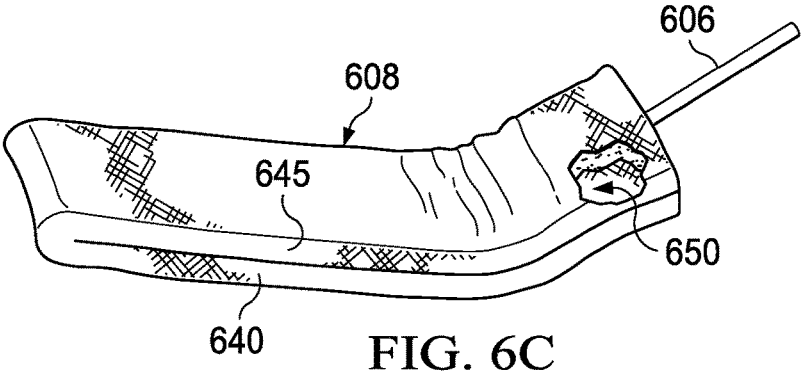

FIGS. 6A-C illustrate a plurality of electrodes 601-602. A radius electrode 601 comprises a stainless steel or copper device comprising an electrode connector 606 and an upper surface 605 having a shape formed from an arc of a circle. In some embodiments, the arc comprises an interior angle of approximately 80 degrees and a radius of approximately 1.75" inches. In some embodiments, the shape is from the arc of an ellipse. The electrode has a height 620 and a length 625.

A flat electrode 602 comprises an electrode connector 606, an upper surface 607, a height 615, and a length 620. In one embodiment, the upper surface of a flat electrode is substantially flat, but one embodiment may have a bend 635 that allows ease of use. The angle of the bend 635 may comprise an angle of approximately 50 degrees.

Electrodes 601-602 comprising metal such as stainless steel or copper require a sleeve 608. In one embodiment, a sleeve is constructed of a fabric folded to form an interior cavity 650 formed from an upper surface 645 and a lower surface 640. In one embodiment, the interior cavity 650 is sized to fit the length of the electrode. The fabric of the sleeve 608 is preferably formed from an absorbent material such as polyester. The fabric is necessary to insulate the metal electrode from directly touching the metal to be cleaned to prevent arcing. The fabric is also necessary to absorb the cleaning solution that is activated by the current flowing from the electrode into the metal to be cleaned. In some embodiments, a cleaning solution comprises 20-50% phosphoric acid solution. After the metal is cleaned, an acid neutralizer solution is used. An electrode 601-602 comprising stainless steel and an insulator sleeve over the electrode may be used with output settings of approximately 32 and 43 volts.

Figure 7A:
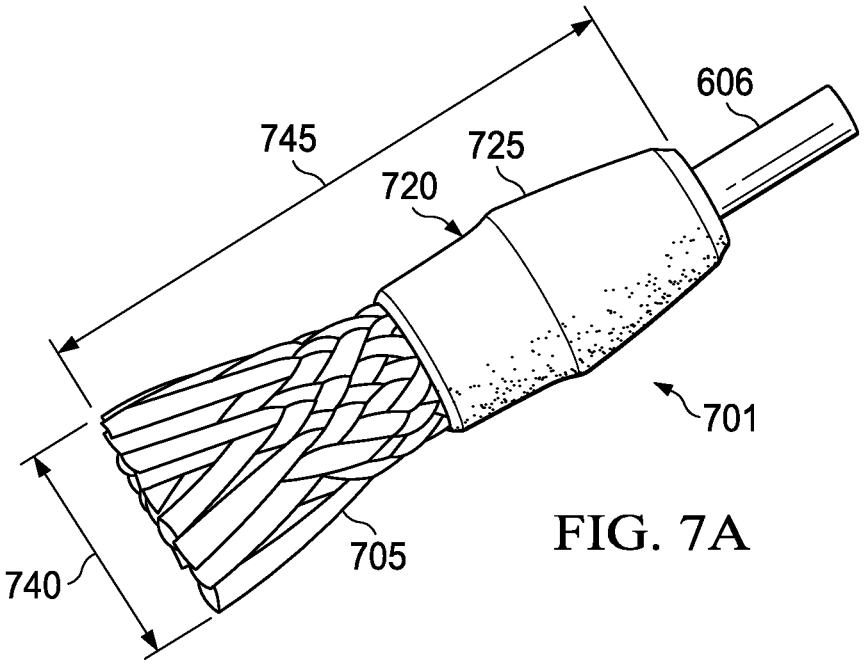
FIGS. 7A-B illustrate exemplary cleaning brushes.
Figure 7B:
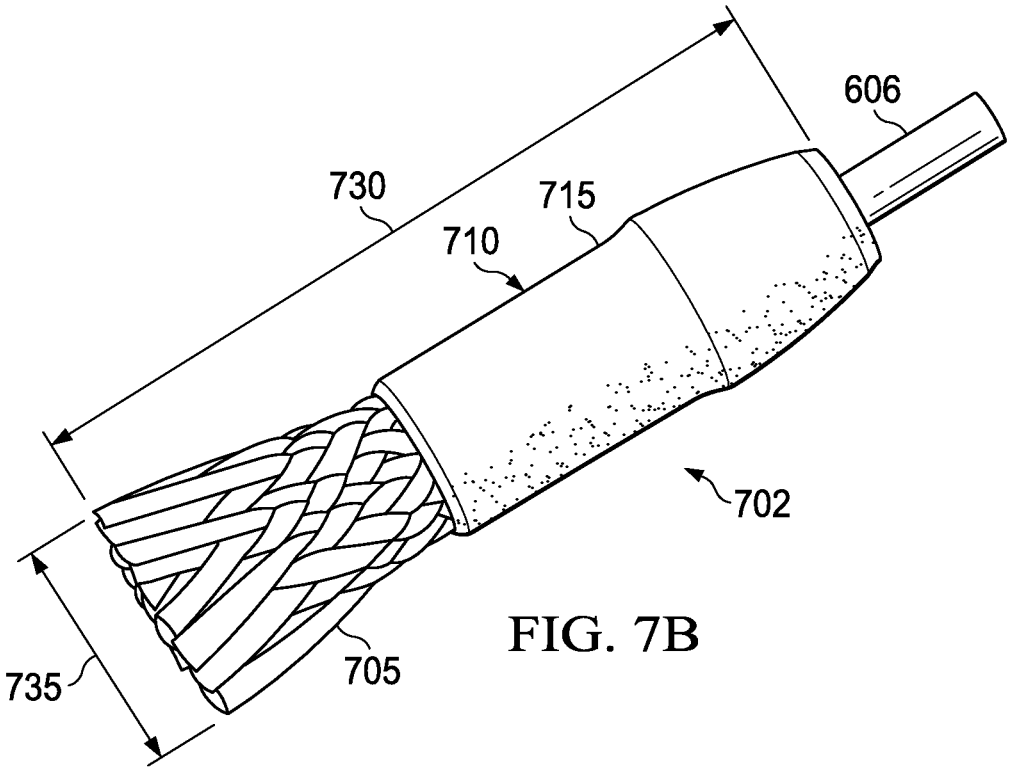

FIGS. 7A-B illustrate exemplary cleaning brushes 701-702 which may be used as an alternative to a metal electrode with a sleeve. In one embodiment, a short carbon fiber brush 701 comprises an electrode connector 606, a ferrule 720, a covering 725, woven fiber bristles, a length 745, and a width 740. In one embodiment, a long carbon fiber brush 702 comprises an electrode connector 606, a ferrule 710, a covering 715, woven fiber bristles 705, a length 730 and a width 735. Carbon fiber brushes 701 and 702 comprise conductive bristles that allow cleaning in hard to reach areas and obviate the need to use an electrode that can create an electrical arc if direct contact is made with a piece being cleaned. A carbon fiber brush in some embodiments is used with an 11 volt potential.

Reference in the foregoing specification to "one embodiment", "an embodiment", or "some embodiments" means that a particular feature, structure, or characteristic described in connection with the embodiment is included in at least one embodiment of the invention. The appearances of the phrase "in one embodiment" in various places in the specification are not necessarily all referring to the same embodiment.

While the exemplary embodiments have been shown and described, it will be understood that various changes and modifications to the foregoing embodiments may become apparent to those skilled in the art without departing from the spirit and scope of the present invention.

What is claimed is:

1. An electrochemical cleaner, comprising:

a power supply coupled with a selectable transformer comprising at least two magnet wires wound around a bobbin;

an electronics housing comprising one or more wand assembly ports and one or more ground ports, wherein a first wand assembly port of the one or more wand assembly ports is electronically coupled with a first wire, a second wire, and a third wire, wherein the first wire, the second wire, and the third wire are coupled with a first magnet wire of the at least two magnet wires of the transformer and the first magnet wire comprises approximately thirty turns around the bobbin between a connection of the first wire and the first magnet wire and a connection of the second wire and the first magnet wire and approximately forty turns around the bobbin between a connection of the second wire and the first magnet wire and a connection of the third wire and the first magnet wire, and a ground connector is electronically coupled by a grounding wire to approximately an end of the first magnet wire, and the first magnet wire comprises approximately ten turns around the bobbin between a connection of a grounding wire and the first magnet wire and a connection of the first wire and the first magnet wire;

a second magnet wire of the at least two magnet wires, the second magnet wire electronically coupled at a first end with a positive output of the power supply and at a second end with a negative output of the power supply;

a voltage selector switch configured to select between a plurality of voltage potentials between a wand assembly port and a ground port; and a wand assembly comprising a handle coupled to a length of wire and an electrode port, the electrode port configured to couple to an electrode shaft, the length of wire coupled to a wand assembly connector plug attachably connectable to one or more wand assembly ports.

2. The electrochemical cleaner of claim 1, further comprising:

a woven carbon fiber brush electrode comprising an electrode shaft coupled woven fiber bristles.

3. The electrochemical cleaner of claim 1, further comprising:

a stainless steel radius device comprising an electrode shaft coupled to an electrode.

4. The electrochemical cleaner of claim 1, further comprising a stainless steel weld cleaning solution.

5. The electrochemical cleaner of claim 1, further comprising a stainless steel weld neutralizing solution.

* * * * *